US005448778A

United States Patent [19]

Phillips

[11] Patent Number: 5,448,778

[45] Date of Patent: Sep. 12, 1995

[54] DETACHABLE SUN SHIELD FOR CAPS

[76] Inventor: Bradway F. Phillips, 10636 Yosemite, Bloomington, Minn. 55437

[21] Appl. No.: 217,194

[22] Filed: Mar. 23, 1994

[51] Int. Cl.[6] ..... A42B 1/06

[52] U.S. Cl. ..... 2/172; 2/181.4; 2/209.13

[58] Field of Search ..... 2/172, 195.1, 195.2, 2/209.13, 171, 181, 181.2, 181.4, 181.6, 195.3, 195.4, 207, 410

[56] References Cited

U.S. PATENT DOCUMENTS

| | | |
|---|---|---|
| 1,491,615 | 4/1924 | Newlen . |
| 2,055,560 | 9/1936 | Rose . |
| 2,870,449 | 1/1959 | Bailey . |
| 4,180,868 | 1/1980 | Snow . |
| 4,980,928 | 1/1991 | Ellis . |
| 5,035,004 | 7/1991 | Koester . |
| 5,046,195 | 9/1991 | Koritan . |
| 5,081,717 | 1/1992 | Shedd et al. . |
| 5,121,507 | 6/1992 | Brown . |
| 5,153,943 | 10/1992 | Clement ..... 2/172 |
| 5,201,077 | 4/1993 | Dondlinger . |

OTHER PUBLICATIONS

Advertisement for Pelican Industries from the magazine *Fine Homebuilding*, Nov. 1992.

Article on "Sun-Blocking Clothes" from the magazine *Redbook*, Aug. 1992.

*Primary Examiner*—Clifford D. Crowder
*Assistant Examiner*—Diana L. Biefeld
*Attorney, Agent, or Firm*—Palmatier, Sjoquist & Helget

[57] ABSTRACT

A sun shield for use with conventional caps having a front bill and a rear band. The sun shield includes a piece of fabric forming a shield portion with a hem along the top edge of the fabric. A strap connects to the hem. The loop so formed is sized to fit around the cap with the strap positioned immediately above the bill. A sleeve formed between two vertical slits or an openable flap in the upper back hem allows insertion of the band of the cap, thus securing the sun shield to the cap.

7 Claims, 3 Drawing Sheets

DETACHABLE SUN SHIELD FOR CAPS

BACKGROUND OF THE INVENTION

The present invention relates to wearing apparel and, more particularly, to a sun shield accessory for caps.

Baseball-style caps with a bill in the front and an adjustment band in the back have become extremely popular and are worn by diverse segments of the population for work and leisure. Although such caps provide some protection by way of the bill for the face of the wearer, the caps leave the neck and ears totally exposed to the sun or other weather elements. Prior art has disclosed shields that are a part of or usable with the traditional cap with a bill, however, these sun shields typically require modification of the cap or have significant other disadvantages relating to ease of use, the comfort of wearing them, or the expense and difficulty of manufacture. For example, the cap with detachable sun shield shown in U.S. Pat. No. 5,201,077 by Dondlinger requires that the cap include a cap band having hook strip material for attachment to the sun shield. U.S. Pat. No. 5,046,195 to Koritan discloses a sun shield which may be used with a cap, however, Velcro® fastening material is again required on the cap to secure the shield to the cap. An alternate embodiment in U.S. Pat. No. 5,046,195 depicts a semirigid plastic part with hooks to engage the band portion of the cap. U.S. Pat. No. 5,081,717 to Shedd utilizes alligator-type clips for attachment to the cap.

Hard plastic or metal parts add expense and complexity to the manufacture of shields. Where the hard parts are positioned between the cap and the wearer's head, or where they otherwise come into contact with the wearer, they can be uncomfortable or annoying. Other attachment means such as alligator clips can damage the cap. Additionally, prior art shields have limited or no flexibility regarding adjustment of the coverage of the shield.

SUMMARY OF THE INVENTION

The present invention provides a new and improved sun shield for use with conventional caps having a front bill and a rear adjustable or fixed band. The sun shield includes a piece of fabric forming a shield portion and an elastic strap. The shield portion has a top edge with two corners and a hem along the top edge. An elastic strap extends from inside the hem at the two corners to form a loop. The loop so formed is sized to fit around the cap with the elastic strap positioned immediately above the bill and the hem of the shield portion wrapped around the back and sides of the cap whereby the shield portion drapes down over the wearer's neck. A sleeve formed by two vertical openings in the upper back hem allows insertion and fastening of the adjustable band of the cap, thus securing the sun shield to the cap.

It is a feature of the present invention to provide a detachable sun shield for use with conventional caps of the type having adjustable rear bands without the necessity of modification of the cap.

It is an object of the present invention to provide a sun shield that is simple in design and construction, facilitating ease of use and ease of manufacture.

Another object of the present invention is to provide a sun shield readily attachable and detachable to conventional baseball-style caps without the utilization of hard hooks, clips, or other solid mechanical fasteners.

It is a further object of the present invention to provide a removably attachable sun shield for conventional caps which can be manufactured from only two portions of material, the sun shield portion and the elastic strap.

It is another object of the invention to provide a sun shield that can remain attached to the cap and may be worn inserted underneath the cap if so desired.

A further advantage of the invention is to provide a sun shield which may also be worn without a cap.

A further object of the sun shield is to provide a shield in which the extent of the coverage around the sides of the head of the wearer may be easily adjusted.

DETAILED DESCRIPTION OF THE PREFERRED EMBODIMENTS

Figure 1:
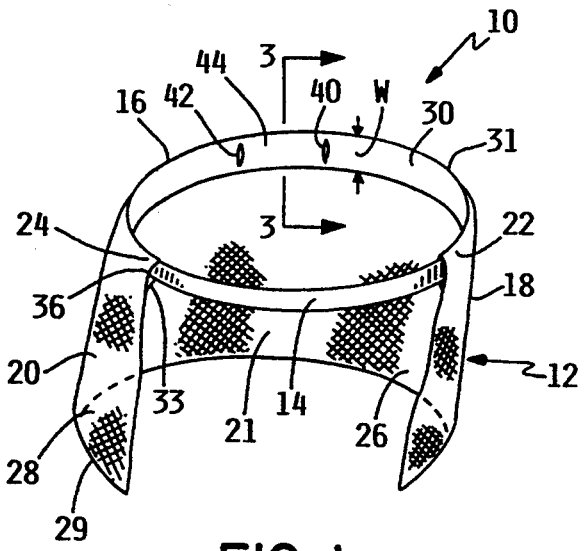
FIG. 1 is a perspective view of the sun shield and shows the sleeve formed from the hem for insertion of the adjustable band of a cap.

The detachable sun shield 10 is shown in FIG. 1 as it would sit on a cap or a wearer's head. The detachable sun shield 10 is comprised of two principal components, the shield portion 12 and the elastic strap 14. The shield portion has a top edge 16, a left side 18, a right side 20, a back 21, two upper corners 22, 24, an inside surface 26, an outside surface 28 and a bottom edge 29. Along the top edge 16 of the shield portion 12 is a hem 30. The elastic strap 14 is connected to the shield portion 12. The elastic strap 14 and the hem 30 form a loop 31. The hem 30 is formed by folding over an appropriate width of material designated by the character "W" and attaching the folded over material to the inside surface 26. The hem 30 has an inside layer 33, and an outside layer 36. Located in the inside layer 33 of the hem 30 proximate the rear of the shield 10 are two vertical openings 40, 42 which communicate with each other through the hem 30. The portion of the hem 30 between the vertical openings 40, 42 forms a sleeve 44. Of course, sleeve 44 could equally well be formed by an openable flap which could be secured by snaps, zippers, Velcro® or the like. For example, either the inside layer 33 or the outside layer 36 could be detachably connected at one end to the hem 30, and the flap could thus be opened to permit the loop 44 to be formed about the cap band 50.

Figure 2:
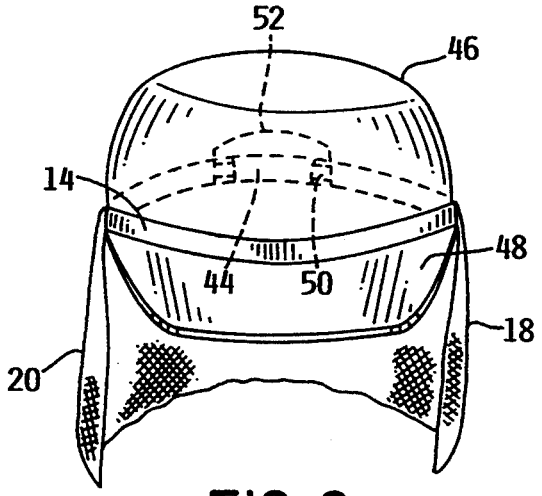
FIG. 2 shows a front perspective view of a conventional baseball-style cap with the sun shield attached.

FIG. 2 shows a front view of the sun shield 10 on a conventional baseball-style cap 46 having a front bill 48 and a separable and adjustable, or fixed, band 50 in the rear of the cap. The cap 46 also includes an inverted U-shaped opening 52 which is bridged by the band 50. The elastic strap 14 is positioned on the cap 46 directly above the bill 48. The cap's band 50 extends through the sleeve 44 of the detachable sun shield 10, securing the sun shield 10 to the cap 46. The loop 31, comprised of the elastic strap 14 and the top edge 16 of the shield portion 12, is sized to loosely stretch fit around the cap 46 as shown.

Figure 3:
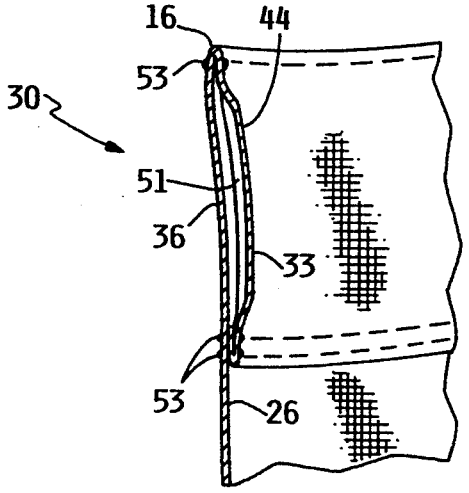
FIG. 3 shows a cross-sectional view taken along line 3—3 of FIG. 1.

FIG. 3 shows an enlarged cross-sectional view of the hem 30 with the sleeve 44 taken at cross sectional line 3—3 of FIG. 1. The shield portion is folded over to form the hem 30 with the top edge 16, the outside layer 36 and the inside layer 33. The inside layer 33, and the outside layer 36 located between the vertical openings 40, 42 comprise the sleeve 44 having an interior 51 for insertion of the band 50 of the cap 46. Stitching 53, or other attachment mechanism, is shown along the top and bottom edges to connect the inside layer 33 to the outside layer 36 to form the sleeve 44.

Figure 4:
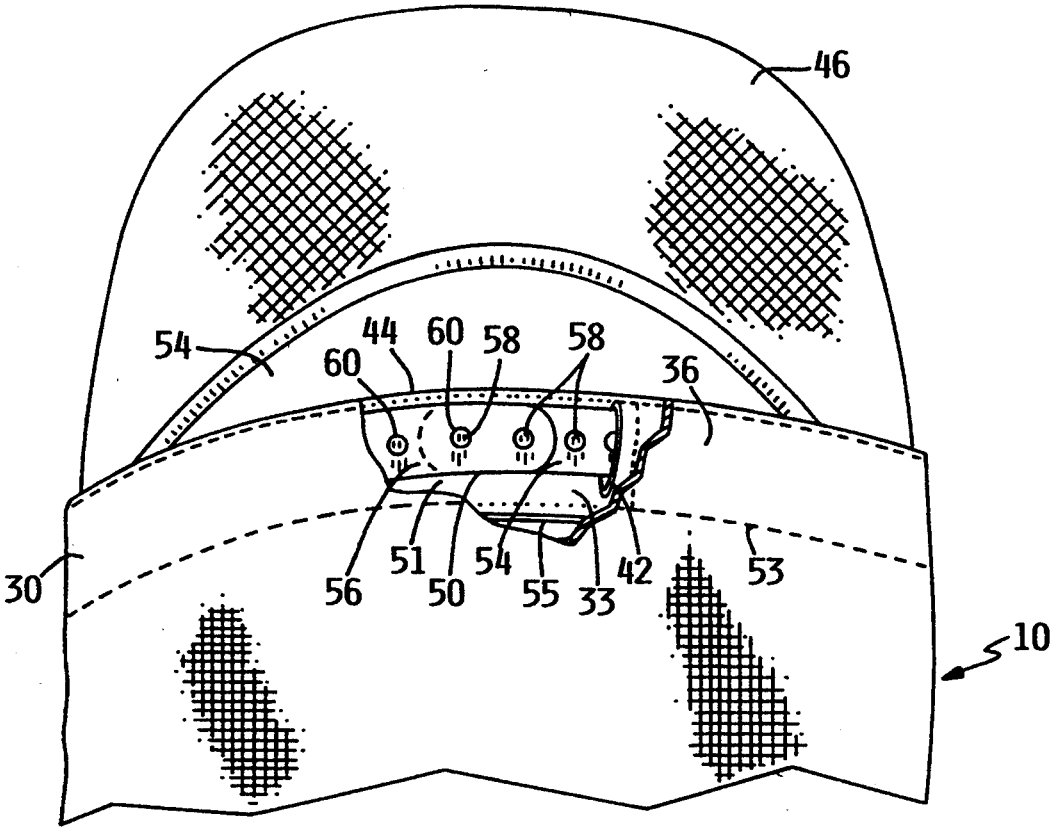
FIG. 4 shows a partial sectional elevational view of the back of a conventional cap with the adjustable band inserted into the sleeve of the sun shield.

FIG. 4 shows a back view of the cap 46. The detachable sun shield 10 is attached with a portion of the outside layer 36 of the hem 30 cut away to reveal the band of the cap 46, and one of the vertical openings 42 in the inside layer 33 of the hem 30. Also shown is the lower edge 55 of the inside layer 33. The sleeve 44 is the portion of the hem between the vertical openings 40, 42. A typical configuration of an adjustable band 50 is shown and is comprised of a first end 54 and a second end 56. The first end 54 has a plurality of protrusions 58 which are engageable into holes 60 located on the second end 56 to adjust the cap 46 for various head sizes. The two ends 54, 56 of the adjustable band are separable from each other. When separated the ends 54, 56 may be inserted into interior 51 of the sleeve 44 through the vertical openings 40, 42 where they are reconnected to secure the sun shield to the cap 46.

Figure 5:
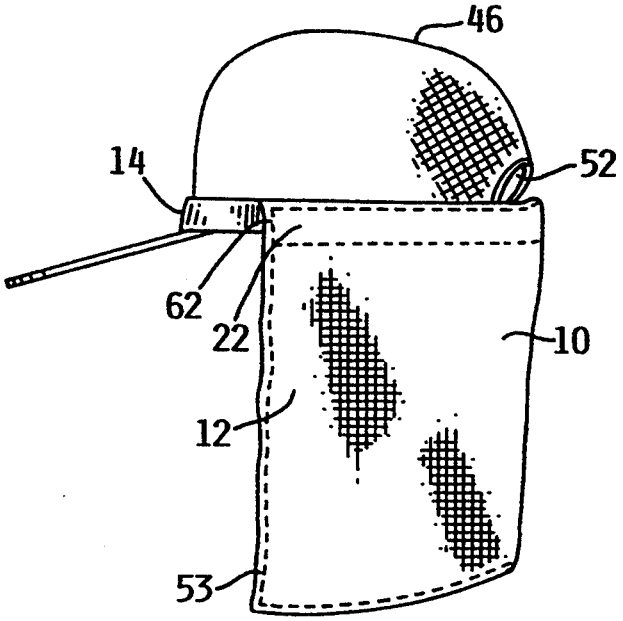
FIG. 5 shows a side elevational view of the sun shield attached to a cap.

FIG. 5 shows a side view of a cap 46 with the detachable sun shield 10. The elastic strap 14 extends from the hem 30 at the corners 22, 24 of the shield portion 12, or between any other two points in the hem 30.

Figure 6:
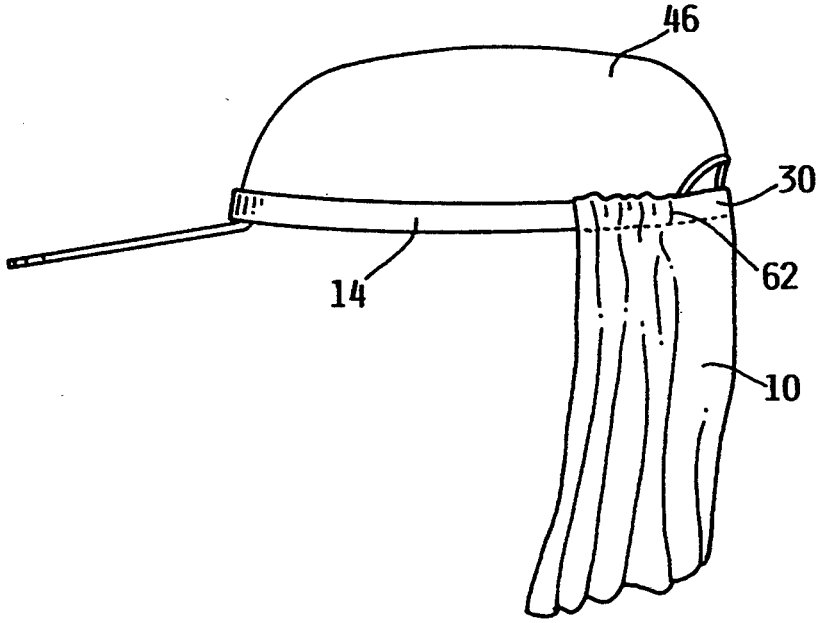
FIG. 6 shows a side elevational view of the sun shield attached to a cap with the side of the shield retracted on the elastic strap.

Referring to FIG. 6, a slightly different embodiment is shown. The elastic strap 14 extends from inside the hem 30 with the attachment means 62 for connecting the elastic strap 14 to the sun shield portion 12 positioned rearwardly toward the back of the shield 10 such as near the sleeve 44. The rearwardly-positioned attachment means 62 permits the sides 18, 20 of the shield 10 to be adjustably retracted along the elastic strap 14 allowing variation in the coverage of the sun shield 10.

The attachment means 62 for attaching the elastic strap 14 to the shield portion 12 may be by stitching or other suitable means such as adhesives or fasteners.

The shield portion 12 material can be of any appropriate composition of cloth, i.e., cotton, polyester, blends or other natural or synthetic fabrics or can be of other thin-sheeted non-fabric materials. The shield portion 12 is sized to cover the back and sides of the neck and may be of any convenient shape such as rectangular, trapezoidal, or crescent shaped.

The elastic strap 14 may be formed of a strip of material commonly known as elastic or other material having sufficient elasticity to maintain the sun shield on the cap. The strap 14 is not necessarily formed as a continuous elastic loop, but may also be formed to allow for a closure such as a snap, buckle or the like. In this circumstance, the strap 14 could be adjusted as to length; and, therefore, the fit about the cap could be adjustable.

The sleeve 44 may also be formed by way of a simple flap extending from the shield portion and folded down and attached by stitching or other suitable means to the inside layer 33 of the shield 10. Additionally, a rectangular portion of material may also be utilized to form the sleeve 44.

The detachable sun shield 10, in addition to its use as a sun shield, may also be utilized in protecting the wearer from other elements such as wind, rain, snow and cold. The sun shield 10 also may be utilized for displaying designs, logos, and the like and can also be worn without a cap.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed is:

1. A detachable sun shield for caps, the caps of the type having a bill at the front of the cap and a band at the back of the cap, the sun shield comprising:

(a) a shield portion formed of a sheet of pliant material, the shield portion having a top edge, and two top corners, the shield portion having a rearward sleeve along and adjacent to the top edge of the shield portion, the sleeve sized for accepting the band;

(b) a strap having two ends;

(c) attachment means for connecting the ends of the strap to the shield portion adjacent to the top edge forming a loop, the loop sized to fit around the cap whereby the strap is positioned above the bill and the sleeve is positioned at the back of the cap, whereby the band may be inserted into the sleeve, and thereby attaching the sun shield to the cap; and (d) a hem along the top edge and, integral with the shield portion, the hem having an inside layer, an outside layer and an interior, the inside layer having two vertical slits rearwardly located and sized to accept the band, the hem intermediate the vertical slits forming a sleeve.

2. The sun shield of claim 1, wherein the attachment means is at the two top corners of the shield portion.

3. The sun shield of claim 1, wherein the strap extends from the interior of the hem.

4. The sun shield of claim 3, wherein the shield portion further comprises two sides and a back, wherein the strap extends rearwardly inside the hem on each side whereby the ends of the strap and the attachment means are positioned rearwardly toward the back, whereby the sides of the shield portion may be retracted on the strap.

5. The sun shield of claim 1, wherein said strap further comprises a strap having at least a portion formed of elastic material.

6. The sun shield of claim 1, wherein the shield portion is made of fabric.

7. The sun shield of claim 1, wherein the attachment means is comprised of stitching.

* * * * *